US011219903B2

(12) United States Patent
Kim et al.

(10) Patent No.: US 11,219,903 B2
(45) Date of Patent: Jan. 11, 2022

(54) APPARATUS FOR TREATING WASTE LEATHER

(71) Applicant: ATKO PLANNING INC., Paju-si (KR)

(72) Inventors: Jieon Kim, Seoul (KR); Bong Jin Choe, Gwangju-si (KR); Kang Gu Lee, Siheung-si (KR); Young Hyeon Choe, Incheon (KR)

(73) Assignee: ATKO PLANNING INC., Paju-si (KR)

( * ) Notice: Subject to any disclaimer, the term of this patent is extended or adjusted under 35 U.S.C. 154(b) by 435 days.

(21) Appl. No.: 16/009,238

(22) Filed: Jun. 15, 2018

(65) Prior Publication Data

US 2018/0369825 A1 Dec. 27, 2018

(30) Foreign Application Priority Data

Jun. 21, 2017 (KR) ..... 10-2017-0078354

(51) Int. Cl.

| | |
|---|---|
| ***B02C 18/14*** | (2006.01) |
| ***B02C 23/16*** | (2006.01) |
| ***B02C 18/18*** | (2006.01) |
| ***B02C 23/30*** | (2006.01) |
| ***B02C 18/00*** | (2006.01) |
| ***C14B 13/00*** | (2006.01) |

(52) U.S. Cl.

CPC ..... *B02C 18/14* (2013.01); *B02C 18/0084* (2013.01); *B02C 18/18* (2013.01); *B02C 23/16* (2013.01); *B02C 23/30* (2013.01); *C14B 13/00* (2013.01); *B02C 2023/165* (2013.01)

(58) Field of Classification Search

CPC ..... B02C 18/14; B02C 18/0084; B02C 18/18; B02C 23/16; B02C 23/30; B02C 2023/165; C14B 13/00; C14B 17/00; C14B 2700/01; C14B 2700/113; B07B 1/20; B07B 1/46; B07B 2201/02

See application file for complete search history.

(56) References Cited

U.S. PATENT DOCUMENTS 2,225,781 A * 12/1940 Hinerfeld ..... B02C 18/144 241/73
5,042,730 A * 8/1991 Hundt ..... B02C 18/143 144/176
5,102,056 A * 4/1992 Ober ..... B02C 13/04 241/100
5,390,865 A * 2/1995 Vandermolen ..... B02C 13/04 241/101.76

(Continued)

FOREIGN PATENT DOCUMENTS

JP 03-023309 Y2 5/1991
KR 10-1982-0000829 B1 5/1982

(Continued)

*Primary Examiner* — Michael McCullough
*Assistant Examiner* — Kalyanavenkateshware Kumar
(74) *Attorney, Agent, or Firm* — Revolution IP, PLLC

(57) ABSTRACT

An apparatus for treating leather waste includes: a main body having an inlet and an outlet; a sorting unit rotatably installed in the main body and comprising a plurality of treatment parts having processing components to sort leather inserted into the main body through the inlet; and a power unit configured to rotate the sorting unit.

6 Claims, 4 Drawing Sheets

(56) References Cited

U.S. PATENT DOCUMENTS

| | | | | |
|---|---|---|---|---|
| 5,605,291 | A * | 2/1997 | Doskocil | B02C 13/04 241/194 |
| 7,278,597 | B2 * | 10/2007 | Fenton | A01D 34/435 241/194 |
| 7,798,436 | B2 * | 9/2010 | Cornelius | B02C 18/083 241/55 |
| 7,950,601 | B2 * | 5/2011 | Watts | B02C 13/1814 241/55 |
| 9,186,683 | B2 * | 11/2015 | Hongo | B02C 13/06 |

FOREIGN PATENT DOCUMENTS

| | | | |
|---|---|---|---|
| KR | 20-1999-0022938 | U | 7/1999 |
| KR | 10-2006-0081182 | A | 7/2006 |
| KR | 10-1501452 | B1 | 4/2015 |

* cited by examiner

APPARATUS FOR TREATING WASTE LEATHER

TECHNICAL FIELD

The present invention relates to an apparatus for treating leather waste, and more particularly, to an apparatus for treating leather waste, which is capable of sorting leather waste to reuse it.

BACKGROUND ART

In general, natural leather is widely used in various fields, such as bags, shoes, and furniture, since it is a tough skin surrounding any animal's body and has excellent physical properties. This natural leather is separated from the body of the animal and then tailored to the designs of products after processing.

However, a large amount of leather waste is generated in such a tailoring process and most of the leather waste is incinerated and buried, which leads to serious environmental problems.

In recent years, various studies have been conducted to recycle leather waste that is incinerated and buried. As a representative example, there was a technique developed to manufacture artificial leather by sorting leather waste and using synthetic resin.

However, the conventional process of sorting leather waste has to be repeatedly performed by means of various devices.

CITATION LIST

Patent Literature (Patent Literature 0001) Korean Patent Application Publication No. 10-2006-0081182

SUMMARY OF INVENTION

Technical Problem

An object of the present invention is to provide an apparatus for treating leather waste, which is capable of minutely pulverizing (sorting) leather through a plurality of treatment parts and further simplifying an entire process by improving quality of pulverized articles.

The present invention is not limited to the above-mentioned object, and other objects of the present invention can be clearly understood by those skilled in the art to which the present invention pertains from the following description.

Solution to Problem

In order to accomplish the object of the present invention, an apparatus for treating leather waste according to an embodiment of the present invention includes a main body having an inlet and an outlet, a sorting unit rotatably installed in the main body and including a plurality of treatment parts having processing components to sort leather inserted into the main body through the inlet, and a power unit configured to rotate the sorting unit. The sorting unit includes a first treatment part having a disc shape and having a plurality of first processing components installed on the front thereof facing the inlet to primarily sort the leather, inserted into the main body through the inlet, by means of the plurality of first processing components, a second treatment part spaced apart from the first treatment part to rotate together with the first treatment part and having a plurality of second processing components formed at one side thereof to secondarily sort the leather sorted by the first treatment part, and a central shaft installed through the main body and receiving torque from the power unit, the first and second treatment parts being installed to the central shaft, and an outer peripheral surface of the first treatment part is spaced at a predetermined distance from an inner surface of the main body to form a gap therebetween, thereby discharging the leather sorted by means of the plurality of first processing components to the second treatment part through the gap.

The main body may have a filter plate therein to filter leather sorted with a predetermined size or less from among the pieces of leather sorted by the sorting unit.

Each of the plurality of first processing components may include a fastening portion fastened to the first treatment part, a latch portion latched to and supported by an outer surface of the first treatment part, and a contact portion protruding outward from the latch portion and having an edge bent at a predetermined angle to be directed in rotational and radial directions of the first treatment part in order to sort the leather.

The second treatment part may include a body installed to the central shaft, a connection shaft installed at one side of the body to connect both side plates of the body, and the plurality of second processing components rotatably installed to the connection shaft.

The power unit may include a motor configured to generate torque, and a power transmission part configured to interconnect the motor and the sorting unit to transmit the force (driving force or movement) of the motor thereto.

The apparatus may further include a blower unit connected to the main body and blowing air at a predetermined pressure to discharge the sorted leather through the outlet, and a storage unit configured to store the sorted leather discharged through the outlet therein.

Advantageous Effects of Invention

In accordance with an embodiment of the present invention, there is provided a sorting unit to pulverize leather inserted into a main body in a multiplex manner. Therefore, it is possible to minutely pulverize the leather and improve quality of pulverized articles. Furthermore, it is possible to enhance productivity and, of course, reduce costs of manufacture by shortening the sorting process that is repeatedly performed in the related art.

The present invention is not limited to the above effects, and it should be understood that the present invention includes all effects which can be inferred from the following detailed description of the present invention or the configuration of the invention defined by the appended claims.

DESCRIPTION OF EMBODIMENTS

Figure 1:
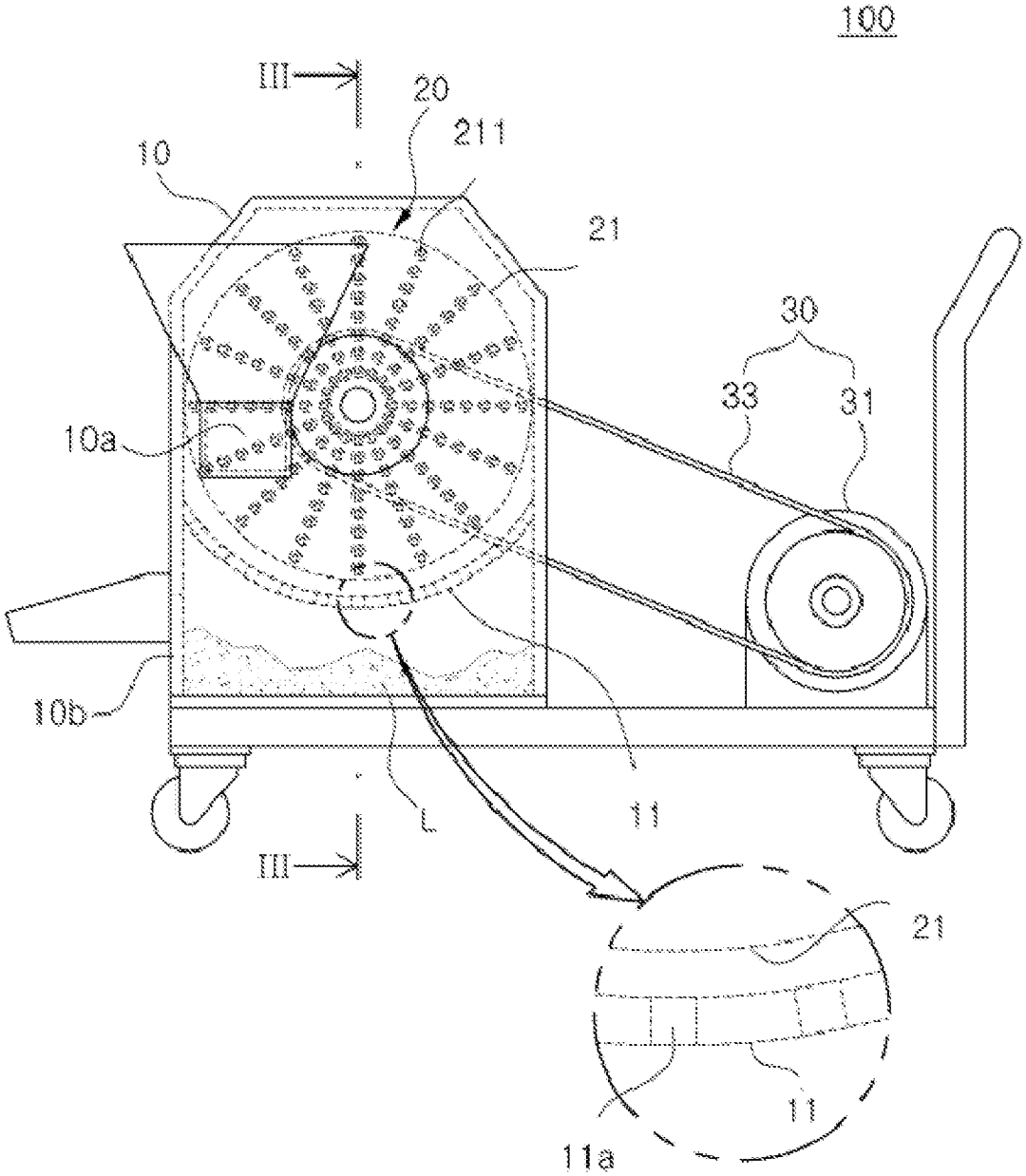
FIG. 1 is a view schematically illustrating an apparatus for treating leather waste according to an embodiment of the present invention.

Reference will now be made in detail to exemplary embodiments of the present invention, examples of which are illustrated in the accompanying drawings. The present invention may, however, be embodied in different forms and should not be construed as limited to the embodiments set forth herein. For clear explanation of the present invention, parts irrelevant to the description may be omitted in the drawings, and like reference numerals refer to like parts throughout the specification.

In the whole specification, it will be understood that when an element is referred to as being "connected (led, contacted, or coupled)" to another element, it can be "directly connected" to the other element or it can be "indirectly connected" to the other element with other elements being interposed therebetween. In addition, it will be understood that when a component is referred to as being "comprising" or "including" any component, it does not exclude other components, but can further comprise or include the other components unless otherwise specified.

The terminology used in the present specification is for the purpose of describing particular embodiments only and is not intended to limit the invention. As used in the specification and the appended claims, the singular forms "a", "an" and "the" are intended to include the plural forms as well, unless context clearly indicates otherwise. It will be further understood that the terms "comprises/includes" and/or "comprising/including" when used in this specification, specify the presence of stated features, integers, steps, operations, elements, components, and/or groups thereof, but do not preclude the presence or addition of one or more other features, integers, steps, operations, elements, components, and/or groups thereof.

Hereinafter, an embodiment of the present invention will be described in detail with reference to the accompanying drawings.

Figure 2:
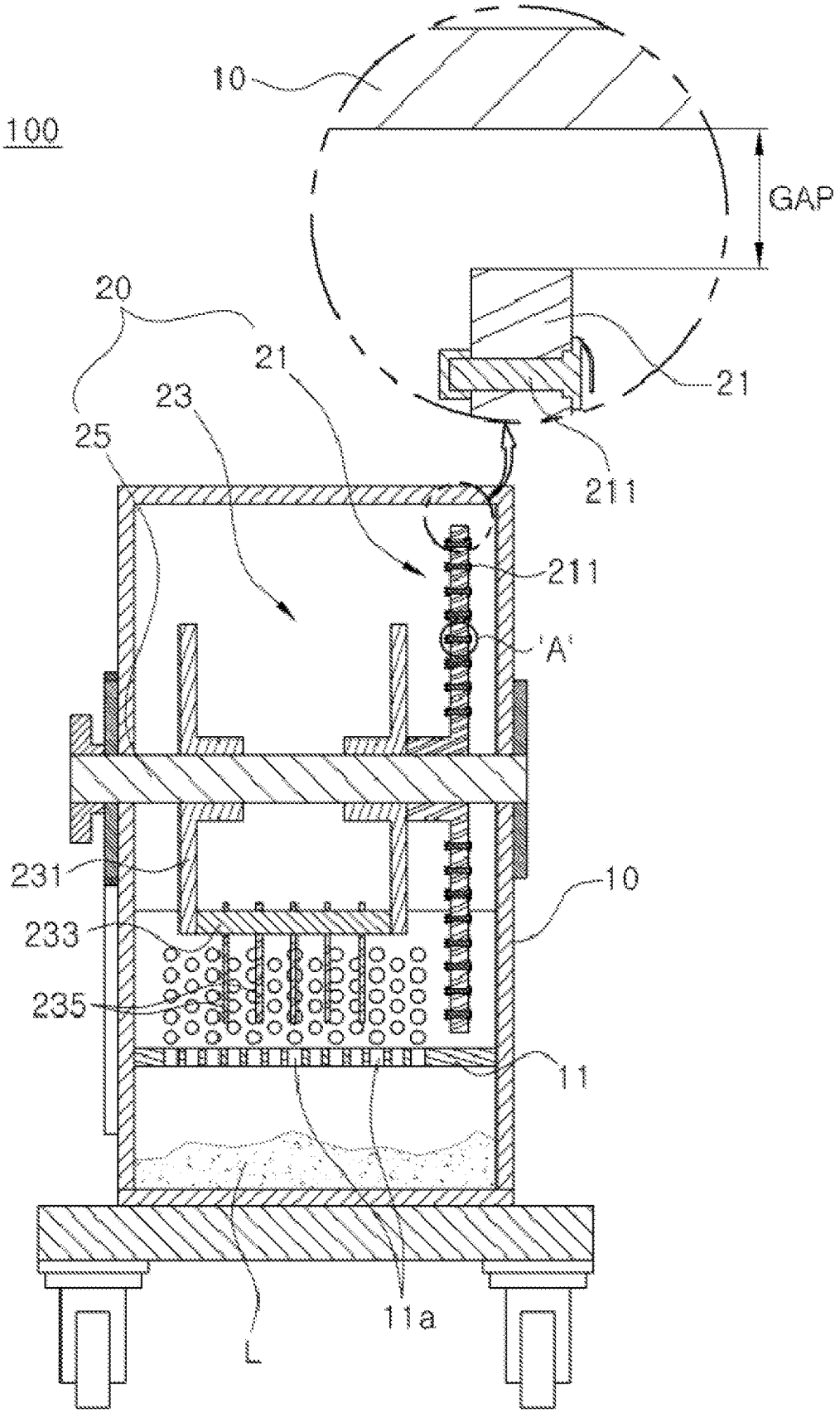
FIG. 2 is a cross-sectional view taken along line "III-III" of FIG. 1.
Figure 3:
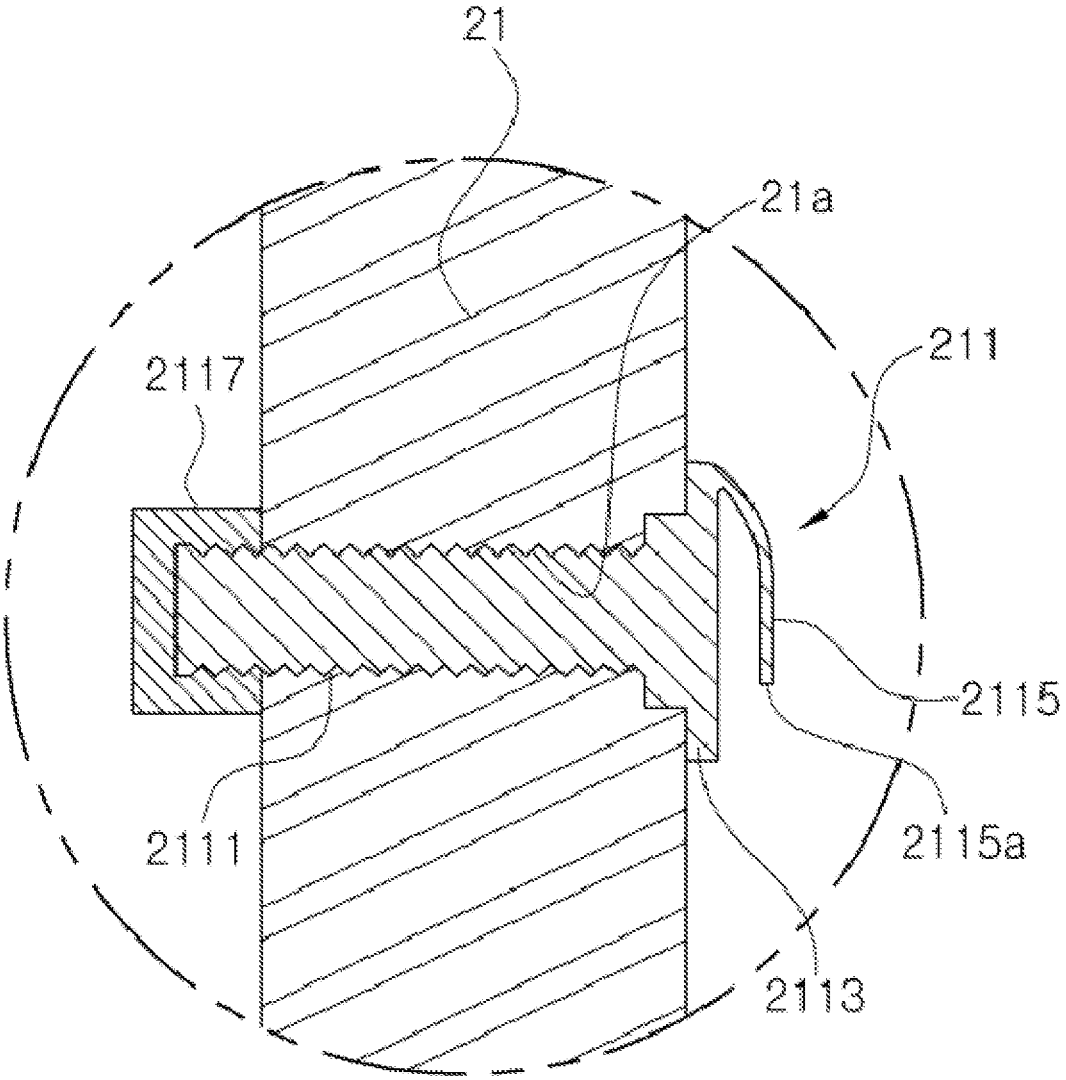
FIG. 3 is an enlarged view illustrating portion "A" of FIG. 2.
Figure 4:
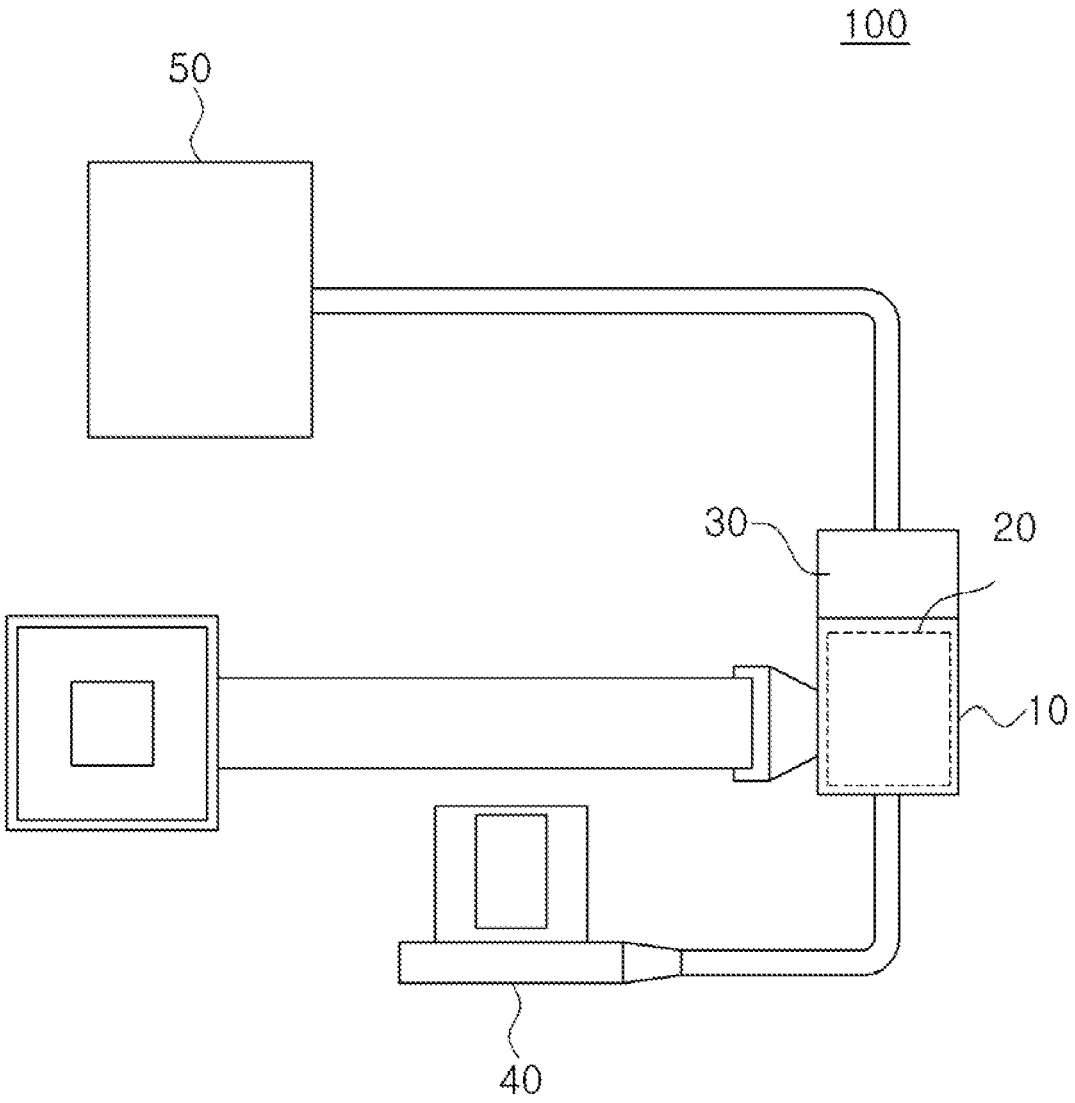
FIG. 4 is a view schematically illustrating a state in which a blower unit and a storage unit are further installed in the apparatus for treating leather waste according to the embodiment of the present invention.

FIG. 1 is a view schematically illustrating an apparatus for treating leather waste according to an embodiment of the present invention. FIG. 2 is a cross-sectional view taken along line "III-III" of FIG. 1. FIG. 3 is an enlarged view illustrating portion "A" of FIG. 2. FIG. 4 is a view schematically illustrating a state in which a blower unit 40 and a storage unit 50 are further installed in the apparatus for treating leather waste according to the embodiment of the present invention.

Referring to FIGS. 1 and 2, the apparatus for treating leather waste, which is designated by reference numeral 100, according to the embodiment of the present invention includes a main body 10.

The main body 10 has a predetermined space defined therein for accommodation of a sorting unit 20 to be described later, and has an inlet 10*a* and an outlet 10*b* which are respectively formed at one side and the other side thereof. The main body 10 may include a filter plate 11 therein to filter leather that is sorted.

In more detail, the filter plate 11 may be disposed inside the main body 10 and partition the internal space of the main body 10 into upper and lower portions. Through such a structure, the sorting unit 20 may be disposed in the upper space of the main body 10 and the lower space of the main body 10 may be defined as a storage space for collection of the sorted leather.

In addition, the filter plate 11 may have a plurality of filter holes 11*a* formed therein.

Thus, the filter plate 11 may communicate with the lower space of the main body 10, and leather sorted with a predetermined size or less from among the pieces of leather sorted by the sorting unit 20 may be collected in the lower space of the main body 10 through the filter holes 11*a*.

In addition, the apparatus for treating leather waste 100 includes a sorting unit 20.

The sorting unit 20 is rotatably installed in the main body 10 and includes a plurality of treatment parts that has processing components 211 for pulverizing and sorting leather to pulverize the leather, inserted into the main body 10 through the inlet 10*a*, in a multiplex manner. In this case, the processing components 211 may each have a sharp area that touches leather.

In more detail, the sorting unit 20 may include a first treatment part 21 that has a plurality of first processing components 211 to pulverize and sort the leather inserted into the main body 10 according to the rotation of the first treatment part 21, and a second treatment part 23 that has a plurality of second processing components 235 to again pulverize and sort the leather sorted by the first treatment part 21.

First, the first treatment part 21 has a disc shape and is disposed to face the inlet 10*a* at the front thereof on which the plurality of first processing components 211 are installed. The first treatment part 21 may primarily sort the leather, which is inserted into the main body 10 through the inlet 10*a*, by means of the plurality of first processing components 211.

Here, a gap (GAP) may be formed between the first treatment part 21 and the main body 10 so that the sorted leather is able to be discharged through the gap.

In more detail, referring to the enlarged portion in FIG. 2, the first treatment part 21 has a smaller diameter than the inner surface of the main body 10. Accordingly, when the first treatment part 21 is installed in the main body 10, the outer peripheral surface of the first treatment part 21 may be spaced at a predetermined distance from the inner surface of the main body 10. Thus, the gap may be formed between the outer peripheral surface of the first treatment part 21 and the inner surface of the main body 10 by a predetermined distance. For example, the first treatment part 21 may be manufactured such that the diameter thereof varies with the degree of sorting of leather.

Thus, the leather sorted by means of the plurality of first processing components 211 included in the first treatment part 21 may be discharged to the second treatment part 23 through the gap formed between the outer peripheral surface of the first treatment part 21 and the inner surface of the main body 10.

Referring to FIG. 3, each of the first processing components 211 may include a fastening portion 2111 that has a thread formed on the outer peripheral surface thereof to be fastened to the first treatment part 21, a latch portion 2113 that is formed at one side of the fastening portion 2111 to be latched to and supported by the outer surface of the first treatment part 21 when the fastening portion 2111 is fastened to the first treatment part 21, and a contact portion 2115 that protrudes outward from the latch portion 2113 to sort leather. Here, the first treatment part 21 may have a fastening hole 21*a* formed therein such that each of the first processing components 211 may be fastened through the fastening hole 21*a* with a thread formed on the inner surface thereof.

Here, the contact portion 2115 may be bent at a predetermined angle.

In more detail, the contact portion 2115 may have an edge 2115*a* that is bent at a predetermined angle to be directed in the rotational and radial directions of the first treatment part 21 in order to strike and pulverize leather when the first treatment part 21 rotates.

In addition, the first processing component 211 may further include a cap-shaped fixing portion 2117 coupled to the fastening portion 2111 that is fastened to the first treatment part 21 to protrude outward thereof.

Next, the second treatment part 23 will be described.

Referring to FIGS. 1 and 2, the second treatment part 23 may be spaced apart from the first treatment part 21 to rotate together with the first treatment part 21 and have a plurality of second processing components 235 formed at one side thereof to secondarily sort the leather sorted by the first treatment part 21.

In more detail, the second treatment part 23 may include a body 231 installed to a central shaft 25 to be described later, a connection shaft 233 installed at one side of the body 231 to connect both side plates of the body 231, and a plurality of second processing components 235 installed to the connection shaft 233 to secondarily sort the leather sorted by the first treatment part 21.

Here, the plurality of second processing components 235 may be installed to be rotatable along the outer peripheral surface of the connection shaft 233 and to each turn around on its axis.

That is, the leather sorted by the first treatment part 21 may be sorted once again by means of the second processing components 235.

The central shaft 25 may be installed through the main body 10 and receive torque from a power unit 30 to be described later. The first and second treatment parts 21 and 23 may be installed to the central shaft 25.

In addition, the apparatus for treating leather waste 100 includes a power unit 30.

The power unit 30 transmits a force for rotating the sorting unit 20.

In more tail, the power unit 20 may include a motor 31 that generates torque, and a power transmission part 33 that interconnects the motor 31 and the sorting unit 20 to transmit the force (driving force or movement) of the motor 31 to the sorting unit 20.

Meanwhile, the apparatus for treating leather waste 100 may further include a blower unit 40 and a storage unit 50.

Referring to FIG. 4, the blower unit 40 may be connected to the main body 10 and may blow air at a predetermined pressure to the lower space of the main body 10 to discharge the sorted leather through the outlet 10*b*. The storage unit 50 may be connected to the outlet 10*b* through a connection pipe such as a duct and may store the sorted leather discharged through the outlet 10*b* by the blower unit 40 therein.

As described above, in accordance with the embodiment of the present invention, the sorting unit 20 is provided to pulverize the leather inserted into the main body 10 in a multiplex manner. Therefore, it is possible to minutely pulverize the leather and improve quality of pulverized articles. Furthermore, it is possible to enhance productivity and, of course, reduce costs of manufacture by shortening the sorting process that is repeatedly performed in the related art.

The above-mentioned embodiments of the present invention are merely examples, and it will be understood by those skilled in the art that various modifications may be made without departing from the spirit and scope or essential features of the invention. Therefore, it should be understood that the embodiments described above are for purposes of illustration only in all aspects and are not intended to limit the scope of the present invention. For example, each component described in a single form may be implemented in a distributed form, and similarly, components described in the distributed form may be implemented in a combined form.

The scope of the present invention is defined by the appended claims, and it should be construed that all modifications or variations derived from the meaning, scope, and equivalent concept of the claims fall within the scope of the invention.

REFERENCE SIGNS LIST

100: apparatus for treating leather waste
10: main body
10*a*: inlet, 10*b*: outlet
11: filter plate, 11*a*: filter hole
20: sorting unit
21: first treatment part, 21*a*: fastening hole
211: first processing component
2111: fastening portion
2113: latch portion
2115: contact portion, 2115*a*: edge
2117: fixing portion
23: second treatment part
231: body
233: connection shaft
235: second processing component
25: central shaft
30: power unit
31: motor
33: power transmission part
40: blower unit
50: storage unit
L: leather

The invention claimed is:

1. An apparatus for treating leather waste, comprising:

a main body having an inlet and an outlet;

a sorting unit rotatably installed in the main body and comprising a plurality of treatment parts having processing components to sort leather inserted into the main body through the inlet; and a power unit configured to rotate the sorting unit, wherein the sorting unit comprises:

a first treatment part having a disc shape and having a plurality of first processing components installed on the front thereof to primarily sort the leather, inserted into the main body through the inlet, by means of the plurality of first processing components; and a second treatment part spaced apart from the first treatment part to rotate together with the first treatment part, the second treatment part comprising:

a single body installed on a central shaft;

a connection shaft installed at one side of the single body to connect both side plates of the single body; and a plurality of second processing components formed at one side thereof to secondarily sort the leather sorted by the first treatment part, wherein the plurality of second processing components are rotatably installed on the connection shaft, wherein the central shaft is installed through the main body and receives torque from the power unit, the first and second treatment parts being installed on the central shaft, wherein the plurality of first processing components is radially arranged from the central shaft.

2. The apparatus according to claim 1, wherein the main body has a filter plate therein to filter leather sorted with a predetermined size or less from among the pieces of leather sorted by the sorting unit.

3. The apparatus according to claim 1, wherein an outer peripheral surface of the first treatment part is spaced at a predetermined distance from an inner surface of the main body to form a gap therebetween, thereby discharging the leather sorted by means of the plurality of first processing components to the second treatment part through the gap.

4. The apparatus according to claim 1, wherein each of the plurality of first processing components comprises:

a fastening portion fastened to the first treatment part;

a latch portion latched to and supported by an outer surface of the first treatment part; and a contact portion protruding outward from the latch portion and having an edge bent at a predetermined angle to be directed in rotational and radial directions of the first treatment part in order to sort the leather.

5. The apparatus according to claim 1, wherein the power unit comprises:

a motor configured to generate torque; and a power transmission part configured to interconnect the motor and the sorting unit to transmit the torque of the motor thereto.

6. The apparatus according to claim 1, further comprising:

a blower unit connected to the main body and blowing air at a predetermined pressure to discharge the sorted leather through the outlet; and a storage unit configured to store the sorted leather discharged through the outlet therein.

* * * * *